US006704969B2

(12) United States Patent
Eschenbruch et al.

(10) Patent No.: US 6,704,969 B2
(45) Date of Patent: Mar. 16, 2004

(54) DEVICE FOR STRENGTHENING A CONVEYABLE FIBER LAP

(75) Inventors: Gregor Eschenbruch, Mönchengladbach (DE); Armin Leder, Mönchengladbach (DE)

(73) Assignee: Trützschler GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/260,418

(22) Filed: Oct. 1, 2002

(65) Prior Publication Data

US 2003/0093879 A1 May 22, 2003

(30) Foreign Application Priority Data

Nov. 19, 2001 (DE) ..... 101 56 734

(51) Int. Cl.[7] ..... D01G 15/40
(52) U.S. Cl. ..... 19/105; 19/106 R
(58) Field of Search ..... 19/105, 98, 65 R, 19/66.1, 66.2, 204, 106 R, 112, 114, 65 CR, 150, 157

(56) References Cited

U.S. PATENT DOCUMENTS 1,185,653 A * 6/1916 Glashower ..... 19/157
3,370,326 A * 2/1968 Law ..... 19/106 R
3,481,004 A * 12/1969 Wright et al. ..... 19/150
3,657,773 A * 4/1972 Whitehurst ..... 19/243
3,890,681 A * 6/1975 Fekete et al. ..... 28/107
4,299,011 A * 11/1981 Rothen et al. ..... 19/106 R
4,315,346 A * 2/1982 Demuth ..... 19/65 CR
4,352,223 A * 10/1982 Graf Felix et al. ..... 19/65 CR
5,909,883 A 6/1999 Jourde et al.
6,345,417 B2 * 2/2002 Leder et al. ..... 19/150

FOREIGN PATENT DOCUMENTS

| | | |
|---|---|---|
| AT | 259246 | 4/1967 |
| DE | 25 30 872 A1 | 1/1976 |
| DE | 31 23 912 A1 | 5/1982 |
| DE | 33 26 281 C1 | 12/1984 |
| DE | 37 00 609 C2 | 7/1988 |
| GB | 898078 | 6/1962 |

* cited by examiner

*Primary Examiner*—Gary L. Welch
(74) *Attorney, Agent, or Firm*—Venable LLP; Robert Kinberg; Stuart I. Smith

(57) ABSTRACT

An endlessly circulating conveying device is provided for strengthening a conveyable fiber lap. The device has first and second converging rollers for conveying the fiber lap. Each roller has an outer surface and at least the first roller is provided with profile elements on its outer surface. The rollers are for subjecting the fiber lap to a pressure when the fiber lap passes through a gap between the rollers, and strengthening the fiber lap by exerting the pressure by the converging rollers and the profile elements.

2 Claims, 6 Drawing Sheets

DEVICE FOR STRENGTHENING A CONVEYABLE FIBER LAP

CROSS-REFERENCE TO RELATED APPLICATION

This application claims priority to German Patent Application No. 101 56 734.0, filed Nov. 19, 2001, the disclosure of which is incorporated herein by reference.

BACKGROUND OF THE INVENTION

The invention relates to a device for strengthening a conveyable fiber lap made, for example, of cotton, synthetic fibers or the like. The device comprises at least one endlessly circulating conveying device having, for example, two rollers. The outer surfaces of the rollers can convey the fiber lap and are provided with elements that engage the fiber lap and have a strengthening effect on the fiber lap.

In practical operations, fiber laps are subjected to repeated needle treatments with needle boards for strengthening the laps. In the process, the lap is stressed in a lap movement direction since the needles plunging into the lap during the needle treatment delay the lap relative to a continuous lap movement. In many cases, this leads to an undesirable longitudinal stretching of the lap. U.S. Pat. No. 5,909,883 discloses a withdrawing roller drive control that reduces the withdrawing speed during the needle intervention to take into account the lap withdrawing resistance which increases as a result of the entering needles. However, the design and control expenditure required for the drive control is comparably high.

Austrian Patent No. 259 246 B1 discloses reducing the tensional stress of the fiber lap during the needle insertion by designing one of a pair of withdrawing rollers such that it has diametrically opposite arranged driver cams for the fiber lap. Depending on the lift frequency of the needle board, a frictional connection between the withdrawing rollers and the lap results only if the lap is released by the :needle board. An intermittent lap conveying drive of this type represents an advantageous precondition for a low-draft needle-treatment of the fiber lap, but also requires an even lap thickness that cannot be ensured in practical operations. Unavoidable thick and thin areas in the lap cause irregularities in the lap advancement, thus resulting in an irregular needle-treatment. In addition, thick areas in the lap can result in surface damage to the lap caused by the driver cams for the withdrawing roller which impacts the lap, possibly leading to a mechanical overload for the withdrawing rollers, particularly in the bearing region.

The known intermittent needle insertion has the further disadvantage of preventing a high operating speed. A previous suggestion called for the needles to be arranged rigidly on the outside surface of a belt that endlessly circulates around two deflection rollers. In the process, the fiber material is drawn, meaning a relative movement takes place between the needles and the fiber material. While the needles are inserted into and pulled out of the fiber material, at the two deflection locations, additional relative movements occur between the needles and the fiber material because the needles are positioned at a slant relative to the fiber material. These movements lead to drafts in a longitudinal direction and, in particular, to an uneven structure of the fiber material.

SUMMARY OF THE INVENTION

Thus, it is an object of the invention to create a device of the above-described type that avoids the aforementioned disadvantages and, in particular, permits a high strengthening speed and a higher strengthening of the fiber lap.

Particular embodiments of the invention provide an endlessly circulating conveying device for strengthening a conveyable fiber lap. The device has first and second converging rollers for conveying the fiber lap. Each roller has an outer surface and at least the first roller is provided with profile elements on its outer surface. The rollers are for subjecting the fiber lap to a pressure when the fiber lap passes through a gap between the rollers, and strengthening the fiber lap by exerting the pressure by the converging rollers and the profile elements.

The invention makes it possible to realize a high strengthening speed and high strengthening of the fiber lap. Two cooperating rollers permit a high circumferential speed and thus a high conveying speed for the fiber lap. The profiled rollers make it possible to have a high strengthening without damaging the fiber lap. In particular, the movement through the converging roller gap results in a pre-strengthening and the profile elements locally (in some locations) cause a main strengthening of the pre-strengthened fiber lap.

BRIEF DESCRIPTION OF THE DRAWINGS

The invention is explained below in further detail with the aid of exemplary embodiments shown in the drawings, wherein:

FIG. 6*b* is a section along line I—I in FIG. 6*a* through two teeth of the sawtooth clothing, arranged side-by-side with wire in-between;

FIG. 6*c* shows the teeth according to FIG. 6*b*, without the wire in-between;

DETAILED DESCRIPTION OF PREFERRED EMBODIMENTS

Figure 1:
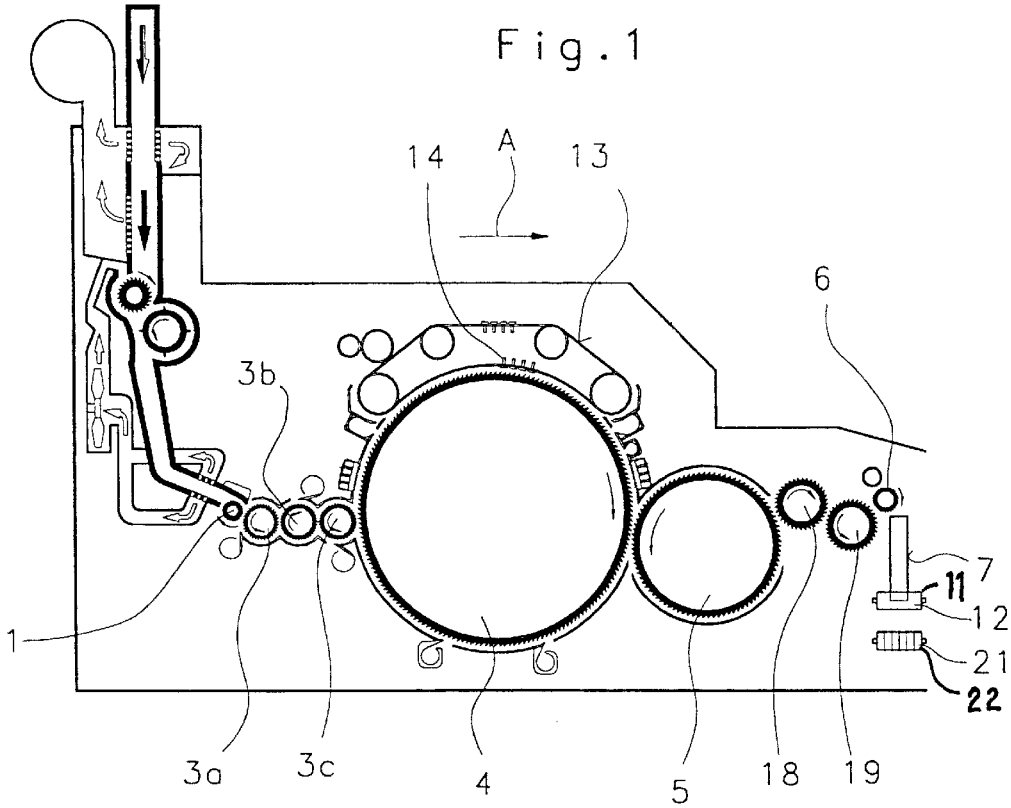
FIG. 1 is a schematic side elevation view of a carding machine provided with a device according to the invention.

FIG. 1 shows a carding machine, for example a high-performance Model DK 903 by the company Trützschler in Mönchengladbach, Germany. The carding machine comprises a feed roller 1, licker-ins 3*a*, 3*b*, 3*c*, a main carding cylinder 4, a doffer 5, a stripping roller 6, a lap-gathering element 7, withdrawing rollers 11, 12 (roller 11 being behind roller 12 and, therefore, not visible in FIG. 1), two profiled rollers 21, 22, and traveling flats 13 with slowly circulating flat bars 14. Curved arrows indicate the rotational directions of the rollers while arrow A indicates the operating direction (fiber material flow direction).

Two gathering rollers 18, 19, which gather the fiber material to form a heavy fiber lap, are arranged between the doffer 5 and the stripping roller 6. The stripping roller 6 rotates clockwise and drops the fiber material from above into the lap-gathering element 7. The lap-gathering element 7 in this example is funnel-shaped (see FIG. 3) and is positioned vertically. The two withdrawing rollers 11, 12 (see FIG. 3) are positioned at the lower end of the lap-gathering element 7 and are followed (in a downward direction) by the two profiled rollers 21, 22 (see FIG. 3).

Figure 2:
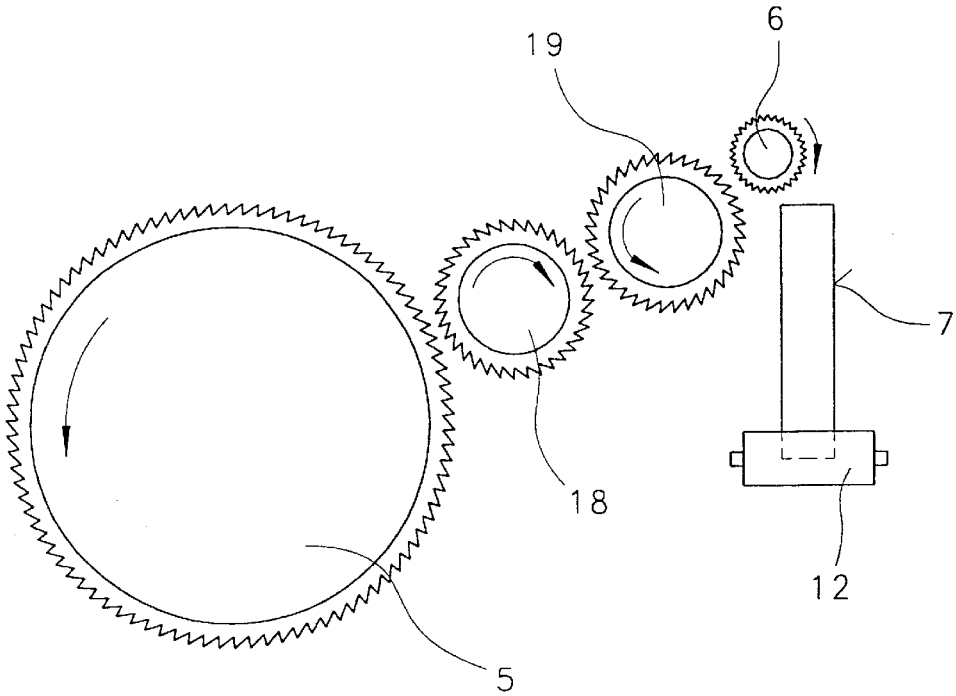
FIG. 2 is a partial side elevation view of the carding machine according to FIG. 1, with two ascending gathering rollers.

As shown in FIG. 2, the gathering rollers 18 and 19 and the stripping roller 6 are arranged in ascending order, following the doffer 5. The fiber material is raised to a specific height and the lap-gathering element 7 can be arranged underneath the stripping roller 6. The released fiber lap then drops downward, aided by the forces of gravity, and into the lap-gathering element 7, which supports the flow of material. The withdrawing rollers 11, 12 withdraw the strengthened fiber lap from the discharge opening of the lap-gathering element 7. The two profiled rollers 21, 22 (FIG. 3) or one profiled roller 22 and one smooth roller 21' (FIG. 4) can be used.

Figure 3:
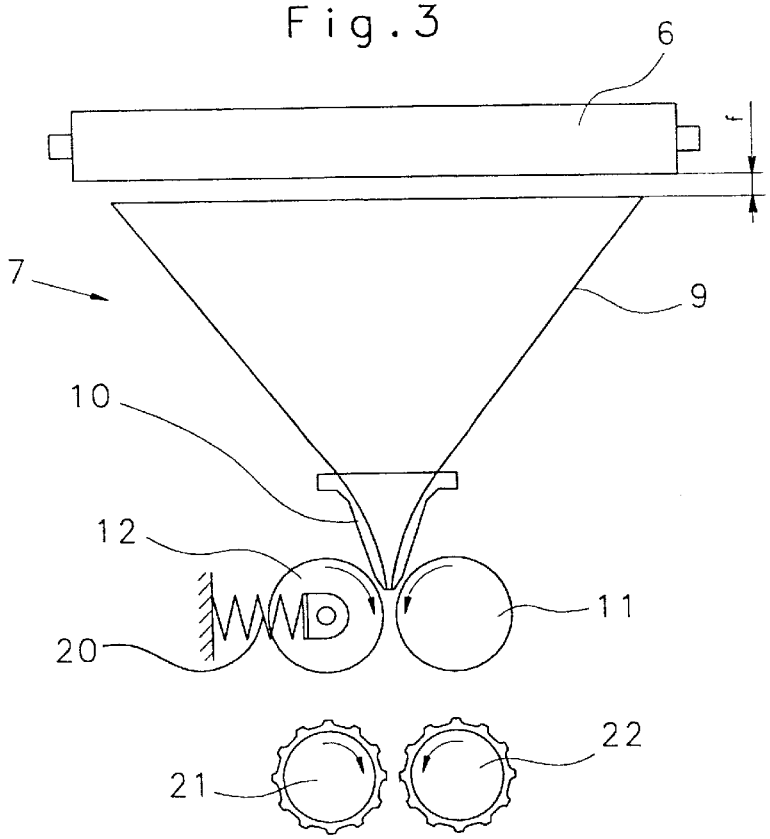
FIG. 3 is a front view of the card discharge according to FIG. 1, comprising two profiled rollers that are connected downstream of the withdrawing rollers.

As seen in fiber material flow direction, the lap-gathering element 7 shown in FIG. 3 is provided with a lap-gathering region and a lap-strengthening region. In FIG. 3, the lap-gathering element 7 has a lap-guide element 9 that forms the lap-gathering region and a lap trumpet 10 that forms the lap-strengthening region. The lap-guide element 9 and the lap trumpet 10 are, in this example, closed on all sides, except for the respective intake and discharge openings for the fiber material. The intake opening for the lap-guide element 9 is arranged at a distance f to the stripping roller 6, for example approximately 50 mm. The profiled rollers 21, 22, which convey the fiber material further and strengthen it, are arranged downstream from the withdrawing rollers 11, 12. In this example, roller 12 is spring-loaded by spring 20. The axes for the withdrawing rollers 11, 12 and the profiled rollers 21, 22 are aligned parallel to each other. The fiber lap exiting from the trumpet 10 respectively passes with its broad side (corresponding to a in FIG. 12) through the gap between the rollers 11, 12 and 21, 22.

Figure 4:
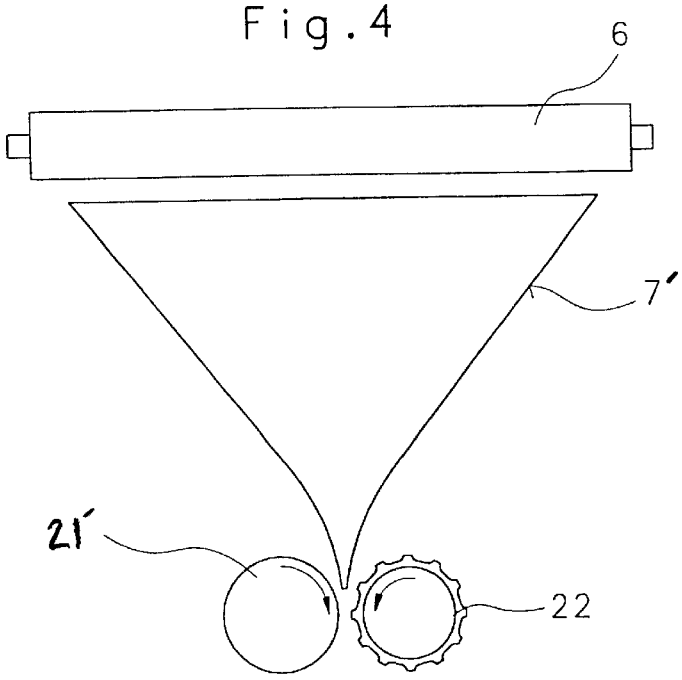
FIG. 4 shows an embodiment of the invention having a profiled roller and a smooth roller.

In the example shown in FIG. 4, the lap-gathering element 7' has a one-piece design. The discharge region for the lap-gathering element 7' corresponds to the discharge region 10*a* (see FIG. 12) of the fiber lap trumpet 10 and extends into the gap between the immediately following roller pair, in this example profiled roller 22 and smooth roller 21'.

All wall surfaces of the lap-gathering element 7, 7' shown in the embodiments of FIGS. 3 and 4, are stationary during the operation, meaning the fiber material glides along the inside wall surfaces of the lap-gathering element 7, 7'. Curved arrows indicate the rotational directions of the rollers 11, 12 and 21, 22.

Figure 5A:
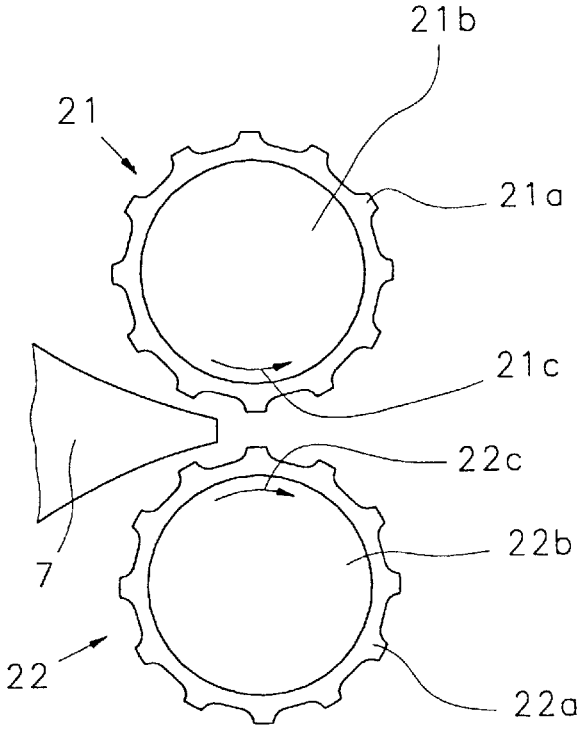
FIG. 5*a* shows two profiled rollers installed downstream of a sliver trumpet.
Figure 5B:
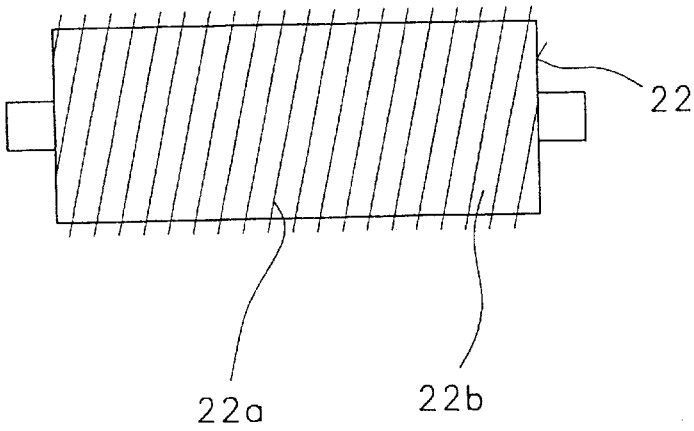
FIG. 5*b* is a front view of a profiled roller according to FIG. 5*a;*

FIG. 5*a* shows two profiled rollers 21, 22, provided with an endless solid-steel clothing 21*a* or 22*a*, which is respectively oriented toward the roller body 21*b* or 22*b*. The roller 21 rotates according to the arrow 21*c* in a counter-clockwise direction and the roller 22 rotates corresponding to arrow 22*c* in a clockwise direction. The discharge from the lap-gathering element 7 extends into the gap between the profiled rollers 21, 22. The lap-gathering element is followed immediately by the two profiled rollers 21, 22. The front view of the roller 22 in FIG. 5*b* shows how the clothing 22*a* is wound helically around the basic roller body 22*b*.

Figure 6A:
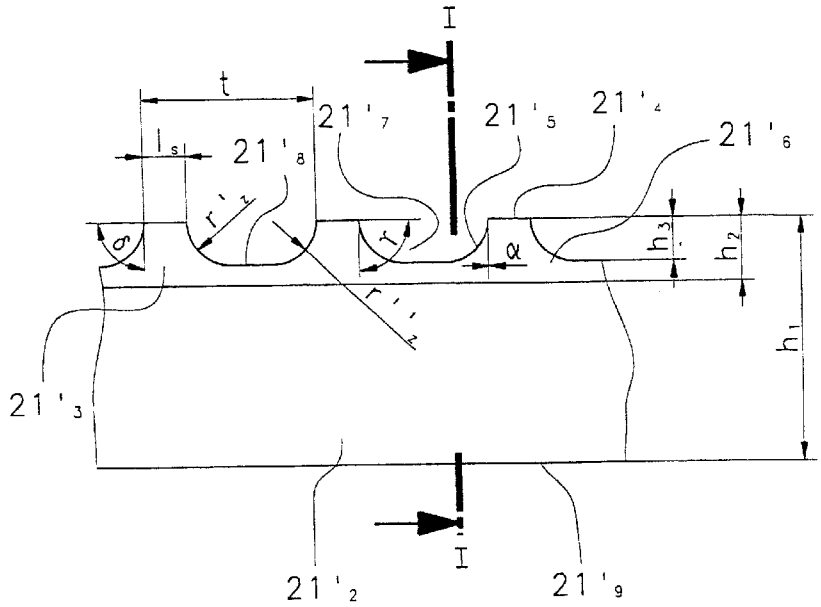
FIG. 6*a* is a side view of sawtooth clothing for the profiled roller(s)
Figure 6B:
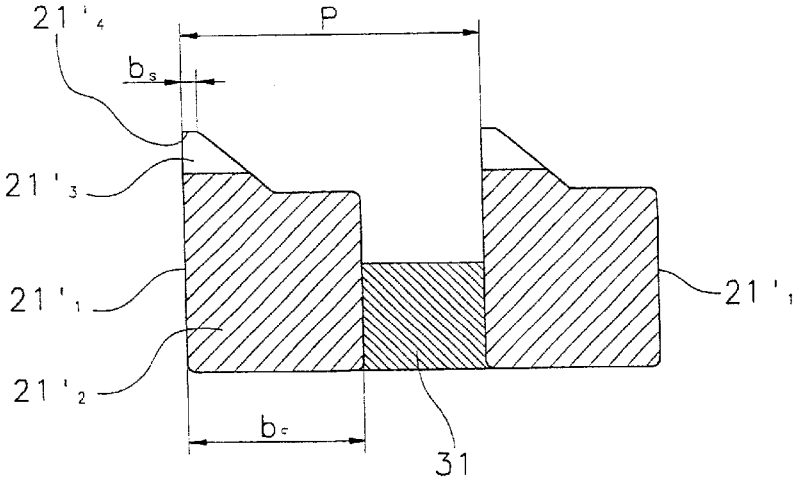

One example of geometric data of the sawtooth clothing 21*a*, 22*a*, selected according to DIN (German Industrial Standard) 64 125, is shown in FIGS. 6*a*, 6*b*. In another embodiment of the invention, the clothing consists of wire needles.

The sawtooth clothing is shown in FIG. 6*a* as a stretched wire with a plurality of teeth $\mathbf{21'}_1$, for example having a height $h_1$ of 2.5 mm. Each tooth $\mathbf{21'}_1$ has a short, straight zone $\mathbf{1}_s$ at the tooth tip $\mathbf{21'}_4$, for example 0.6 to 1.5 mm, which is oriented parallel to the base plane $\mathbf{21'}_9$ of the tooth base $\mathbf{21'}_2$. Each tooth $\mathbf{21'}_1$ furthermore has a tooth front $\mathbf{21'}_5$ and a tooth back $\mathbf{21'}_6$. The front angle $\alpha$ is 0°. The angle $\delta$, the angle between the straight zone of the tooth tip $\mathbf{21'}_4$ and the perpendicular line relative to the tooth base plane $\mathbf{21'}_9$ of the tooth base $\mathbf{21'}_2$, amounts to 90°.

The back angle $\gamma$, the angle between the straight zone $\mathbf{21'}_4$ and the perpendicular line is 90°. The tooth region above the tooth base $\mathbf{21'}_2$ is given the reference $\mathbf{21'}_3$ and has a height $h_2$. A tooth gap $\mathbf{21'}_7$ respectively exists between a tooth front $\mathbf{21'}_5$ and a tooth back $\mathbf{21'}_6$ of two adjacent teeth $\mathbf{21'}_1$. The tooth gap $\mathbf{21'}_7$ has two arcs of approximately one fourth of a circle and a gap bottom $\mathbf{21'}_8$ that connects the two arcs. The radii of the two arcs for the tooth gap $\mathbf{21'}_7$ are identical to the tooth radii $r'_z$ and $r''_z$, for example amounting to approximately 0.6 mm. The tooth gap height $h_3$ is approximately 0.6 mm to 1.5 mm. The tooth division t (on the stretched wire) is approximately 2.45 mm to 2.85 mm.

Figure 6C:
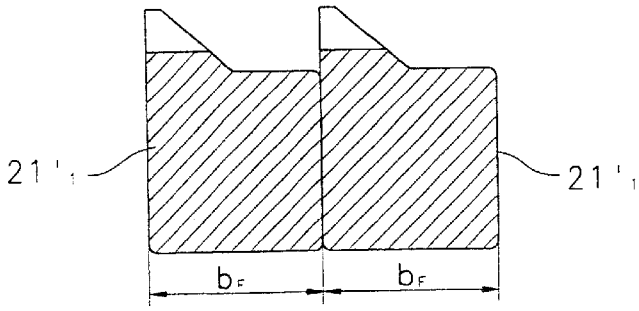

The two teeth $\mathbf{21'}_1$, shown in a sectional view in FIG. 6*b*, have a pitch P. A spacing wire 31 is arranged between the teeth $\mathbf{21'}_1$ which is wound endlessly around the roller body 21*b*, in the same way as the sawtooth clothing. However, according to FIG. 6*c* the teeth $\mathbf{21'}_1$ can also be arranged immediately adjacent to each other, without any spacing in-between. The tip width $b_s$ of tooth $\mathbf{21'}_1$, for example, can be more than 0.2 mm and less than 1 mm. The base width $b_F$ of the tooth $\mathbf{21'}_1$ can be more than 1 mm and less than 4 mm, for example 2 mm. The tooth density T=10/t can be approximately 3.5 to 4.0/cm. The number of windings per unit $z=10/b_F$ can be approximately 4.8 to 5.2/cm and the density=G×T can be approximately 18.5 to 19.5 $cm^2$.

Figure 7:
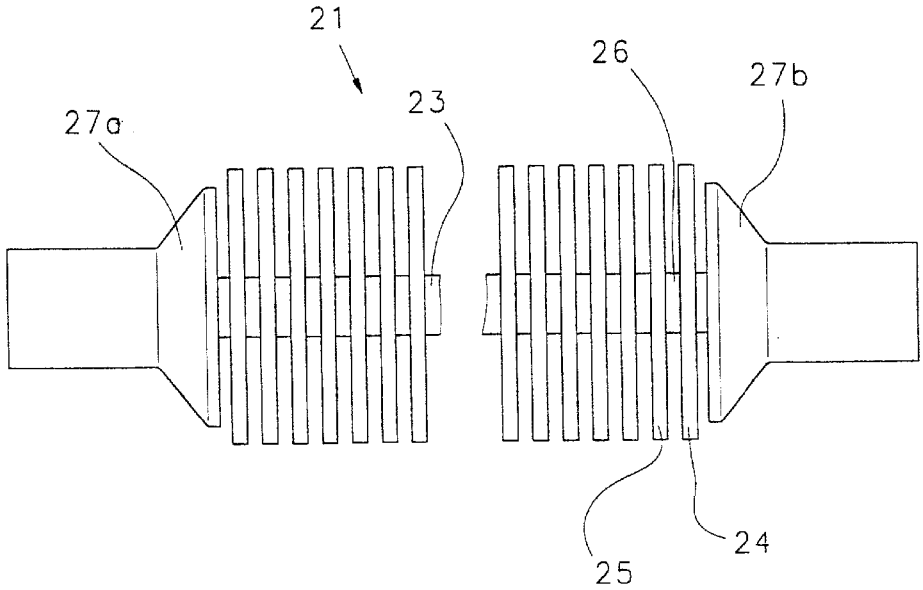
FIG. 7 is a front view of a profiled roller, composed of side-by-side arranged toothed disks with spacers inserted between them.

As shown in FIG. 7, the profiled roller 21, 22 can be configured as a disk-type roller. Profiled disks 24, 25 (see FIGS. 8, 9) are arranged side-by-side on a shaft 23, wherein one spacing disk 26 is provided between two adjacent disks 24, 25. Holding elements 27*a*, 27*b* are respectively arranged on the two ends of the disk packet. The holding elements are secured, for example, with screws and hold together and press together the disks 24, 25 and spacers 26.

Figure 8:
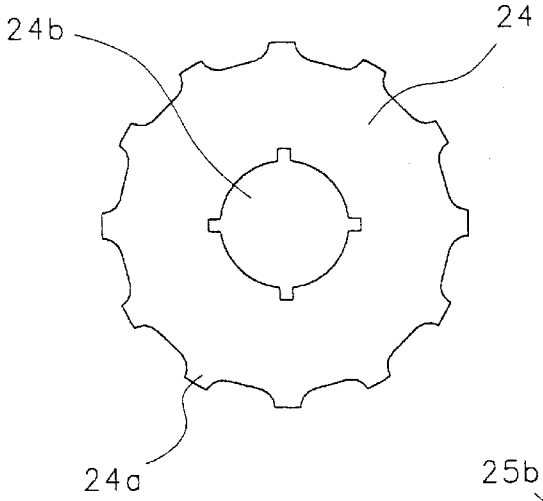
FIG. 8 shows a first embodiment of the toothed disks according to FIG. 7 with approximately trapezoid profile projections along the circumference.
Figure 9:
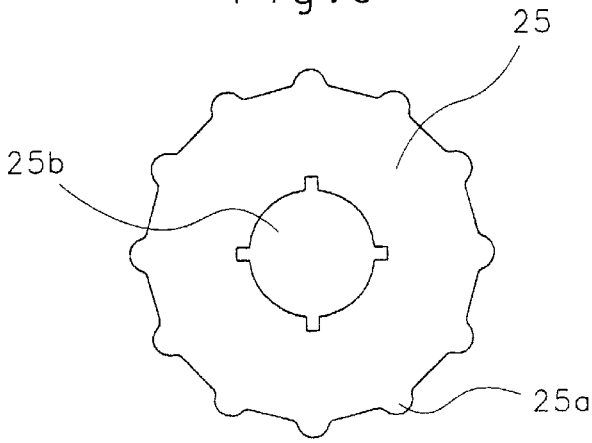
FIG. 9 shows a second embodiment of the toothed disks according to FIG. 7 with convex curved profile projections along the circumference.

In the example shown in FIG. 8, the profile elements 24*a* along the circumference of disk 24 are shaped in the manner of a trapeze or pyramid. Disk 24 is provided, in this example, with a keyed hole 24*b* for mounting on shaft 23. In the example shown in FIG. 9, the profile elements 25*a* along the circumference of disk 25 are shaped approximately semi-circular or semi-spherical. Disk 25 is provided, in this example, with a keyed hole 25*b* for mounting on shaft 23. Different profile element shapes that are suitable for the primary strengthening can be used as well.

Figure 10:
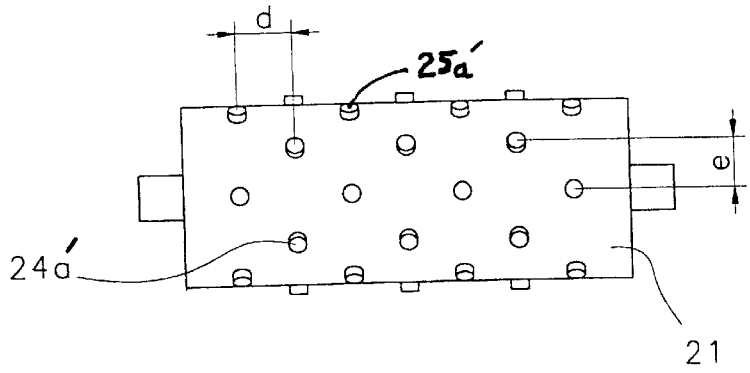
FIG. 10 is a front view of a profiled roller with profile elements.

FIG. 10 shows an embodiment where the profile elements 24*a'* and 25*a'* are arranged directly on the basic roller body.

In FIG. 10, the profile elements 24*a*', 25*a*' are arranged offset to each other. The lap strengthening can be improved by such a roller. The spacing of the profile elements in a width direction is indicated by d and the offset in the rotational direction between adjacent profile elements is indicated by e.

Figure 11:
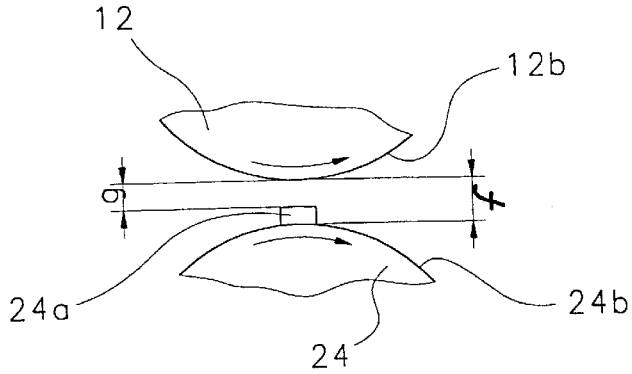
FIG. 11 is a schematic representation of the distances between the basic roller bodies and the profile elements for the pre-strengthening and the main strengthening.

In FIG. 11, the pre-strengthening occurs between the outer surface 12*b* of roller 12 and the outer surface 24*b* of disks 24 and the main strengthening occurs between the outer surface 24*b* and the exposed end of the profile element 24*a*. The distance between the outer surface 12*b* and the outer surface 24*b* is indicated by f and the distance between the outer surface 12*b* and the exposed end of the profile element 24*a* is indicated by g. The pre-strengthening and the main strengthening occur in the same way as for the profiled rollers with sawtooth clothing, shown in FIGS. 5*a*, 5*b* and 6*a*, 6*b*.

Figure 12:
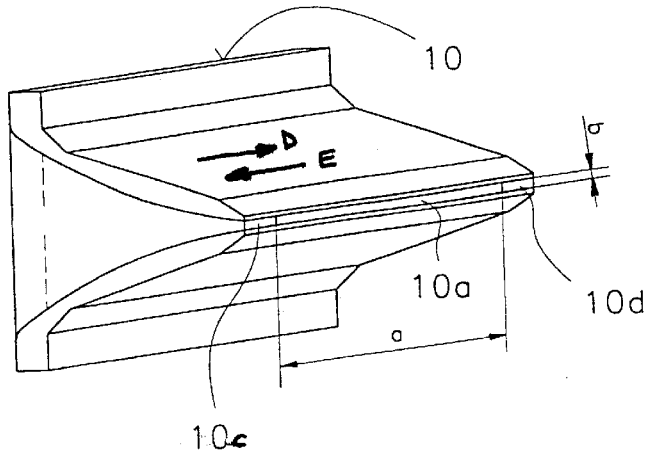
FIG. 12 is a perspective view of a fiber lap (sliver) trumpet with a rectangular discharge region.

According to FIG. 12, the discharge opening 10*a* of the fiber lap trumpet 10 has a height b of approximately 2 to 3 mm. The width a of the discharge opening 10*a* for the trumpet 10 is at least approximately 30 to 100 mm, preferably approximately 2 to 30 mm. Wall elements 10*c* and 10*d* define sides of the discharge opening 10*a*. The width a can be changed by displacing wall element 10*c* in the region of the discharge opening 10*a* in the direction of arrows D, E. The rectangular region 10*a* is designed with sharp edges. In this way, the flat fiber lap that exits the lap trumpet has a sharp-edged cross-sectional shape.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. An endlessly circulating conveying device for strengthening a conveyable fiber lap, the device comprising:

first and second converging rollers for conveying the fiber lap, each roller having an outer surface, at least the first roller being provided with profile elements on its outer surface, wherein the rollers are for subjecting the fiber lap to a pressure when the fiber lap passes through a gap between the rollers, and strengthening the fiber lap by exerting the pressure by the converging rollers and the profile elements, and the first roller further comprises a plurality of profile disks and a plurality of spacing disks, the profile elements protruding from an outer circumference of the profile disks.

2. A carding machine for producing a fiber sliver, comprising:

a main carding cylinder; and the endlessly circulating conveying device according to claim 1, wherein the endlessly circulating conveying device is located downstream of the main carding cylinder.

* * * * *